US012123332B2

(12) United States Patent
Hasan et al.

(10) Patent No.: US 12,123,332 B2
(45) **Date of Patent: *Oct. 22, 2024**

(54) EXHAUST DISCHARGE SYSTEM

(71) Applicant: Caterpillar Inc., Peoria, IL (US)

(72) Inventors: Saad Hasan, Naperville, IL (US); Gerald W. Gavin, Big Rock, IL (US); Daniel Allen Hatfield, Rochelle, IL (US); Jingshu Wu, Katy, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/207,321

(22) Filed: Jun. 8, 2023

(65) Prior Publication Data

US 2023/0323805 A1 Oct. 12, 2023

Related U.S. Application Data

(63) Continuation of application No. 17/568,453, filed on Jan. 4, 2022, now Pat. No. 11,732,633.

(51) Int. Cl.
*F01N 13/08* (2010.01)
*B60K 13/04* (2006.01)
(Continued)

(52) U.S. Cl.
CPC ..... *F01N 13/082* (2013.01); *E02F 9/0866* (2013.01); *F01N 2340/04* (2013.01);
(Continued)

(58) Field of Classification Search
CPC .... F01N 13/082; F01N 13/08; F01N 2340/04; F01N 2470/10; F01N 2470/24;
(Continued)

(56) References Cited

U.S. PATENT DOCUMENTS 3,792,722 A * 2/1974 Harmon ..... F01N 13/1805 181/227
4,487,289 A * 12/1984 Kicinski ..... F01N 3/05 181/263

(Continued)

FOREIGN PATENT DOCUMENTS

KR 20090095056 A * 9/2009
KR 20120034021 A * 4/2012
KR 20130010602 A * 1/2013

OTHER PUBLICATIONS

Ebay, "2114635 211-4635 Pipe Exhaust OEM Original CAT Caterpillar 735 Stack Extension", https://www.ebay.com/itm/184324273695.

*Primary Examiner* — Edgardo San Martin
(74) *Attorney, Agent, or Firm* — von Briesen & Roper, s.c.

(57) ABSTRACT

An exhaust discharge system is disclosed. The exhaust discharge system comprises an exhaust stack including a first conduit and a second conduit. The first conduit defines a first flow passageway and arranged around a first longitudinal axis. The first conduit including a skirt portion and a body portion disposed downstream of the skirt portion, and the skirt portion is oriented to slope outward from the body portion. The second conduit is disposed downstream of the first conduit. The second conduit defines a second flow passageway and is arranged around a second longitudinal axis, the second conduit includes a sidewall and an exit port, the exit port having an exit-port cross-section, wherein the exit-port cross-section is oblong in shape. The second longitudinal axis is disposed at an intersection angle to the first longitudinal axis, the intersection angle in a range of 125° to 150°. The exhaust stack is configured to convey treated exhaust from the skirt portion to the exit port.

15 Claims, 5 Drawing Sheets

(51) Int. Cl.
*E02F 9/08* (2006.01)
*F23J 11/04* (2006.01)
*F23J 11/06* (2006.01)

(52) U.S. Cl.
CPC ..... *F01N 2470/10* (2013.01); *F01N 2470/24* (2013.01); *F01N 2590/08* (2013.01)

(58) Field of Classification Search
CPC ..... F01N 2470/30; F01N 2590/08; F01N 2590/00; E02F 9/0866; E02F 9/0858; E02F 9/08; B60K 13/04; F23J 11/04; F23J 11/06
See application file for complete search history.

(56) References Cited

U.S. PATENT DOCUMENTS 4,638,632 A * 1/1987 Wulf ..... F01N 13/082 60/264
5,170,020 A * 12/1992 Kruger ..... F01N 13/082 181/227
6,302,066 B1 * 10/2001 Steinmann ..... E02F 9/0866 123/41.49
7,207,172 B2 * 4/2007 Willix ..... B62D 25/10 60/319
8,046,989 B2 11/2011 VanderGriend et al.
8,286,422 B2 * 10/2012 Yang ..... F01N 3/05 60/320
8,402,758 B2 3/2013 Castner et al.
8,443,932 B2 * 5/2013 Miyahara ..... E02F 9/0866 181/227
8,631,895 B2 1/2014 Tanaka et al.
8,931,266 B2 * 1/2015 Uchida ..... F16L 3/08 60/272
9,115,632 B2 * 8/2015 Wolfcarius ..... F01N 13/08
9,528,415 B2 12/2016 Brandl et al.
10,851,698 B2 * 12/2020 Ji ..... F01P 1/06
11,732,633 B2 * 8/2023 Hasan ..... F01N 13/082 181/227
2011/0151760 A1 6/2011 Olsen
2012/0048631 A1 * 3/2012 Shatters ..... B60K 11/00 180/68.1
2012/0125271 A1 * 5/2012 Bada Ghar Wala .... F01N 3/055 123/41.04
2012/0145268 A1 * 6/2012 Clarke ..... F01N 13/082 138/40
2013/0161112 A1 * 6/2013 Grzesiak ..... B60K 13/02 138/140
2014/0020638 A1 * 1/2014 Park ..... F01P 1/00 123/41.01
2014/0106659 A1 * 4/2014 Hong ..... B60K 11/06 454/162
2014/0373947 A1 * 12/2014 Hong ..... E02F 3/36 137/544
2015/0377192 A1 * 12/2015 Nathak ..... F01N 13/082 123/184.21
2017/0284059 A1 * 10/2017 Takeyama ..... B60K 13/02

* cited by examiner

EXHAUST DISCHARGE SYSTEM

CROSS REFERENCE TO RELATED APPLICATION

This application is a continuation application under 35 U.S.C. § 120 of U.S. patent application Ser. No. 17/568,453 filed on Jan. 4, 2022.

TECHNICAL FIELD

The present disclosure generally relates to exhaust discharge systems for machines, and more particularly, to exhaust discharge systems for earth moving machines.

BACKGROUND

Internal combustion engines, including diesel engines, gasoline engines, natural gas engines, turbine engines, and other engines known in the art are used to drive many types of power systems. Exhaust from the internal combustion engines is typically discharged into the atmosphere. An exhaust stack may extend outward from an engine or from an enclosure of the engine in order to discharge the exhaust.

U.S. Pat. No. 8,402,758, issued Mar. 26, 2013, (the '758 patent) describes an exhaust pipe that includes a body that has a plurality of inner diffusion ports extending through the body. The body is sized to have a cross-sectional area that is smaller than the cross-sectional area of the exit plane of the exhaust pipe to create a plurality of outer diffusion ports around at least a portion of the outer perimeter of the body to slow exhaust gas flow, decrease the distance that the plume of the exhaust gas travels, and spread gas over a larger exit area. While the '758 patent may be beneficial, a better exhaust stack is desired.

SUMMARY

In one aspect of the present disclosure, an exhaust discharge system is disclosed. The exhaust discharge system comprises an exhaust stack. The exhaust stack is disposed downstream of the ejector tube and is in fluid communication with the ejector tube via the outlet. The exhaust stack includes a first conduit and a second conduit. The first conduit defines a first flow passageway and is arranged around a first longitudinal axis. The first conduit may include a skirt portion and a body portion disposed downstream of the skirt portion. The skirt portion may be oriented to slope outward from the body portion. The second conduit is disposed downstream of the first conduit. The second conduit defines a second flow passageway and is arranged around a second longitudinal axis. The second conduit includes a sidewall and an exit port. The exit port has an exit-port cross-section, wherein the exit-port cross-section is oblong in shape. The second longitudinal axis is disposed at an intersection angle to the first longitudinal axis. The intersection angle may be in a range of 125° to 150° and the exhaust stack is configured to convey treated exhaust from the skirt portion to the exit port.

In another aspect of the disclosure, a method of assembling an exhaust discharge system for a machine is disclosed. The exhaust discharge system includes an exhaust stack having a first conduit and a second conduit. The first conduit defines a first flow passageway and is arranged around a first longitudinal axis. The first conduit may include a skirt portion and a body portion. The skirt portion may be oriented to slope outward from the body portion. The second conduit defines a second flow passageway downstream of the first flow passageway and is arranged around a second longitudinal axis. The second conduit includes a sidewall and an exit port. The exit port has an exit-port cross-section. The exit-port cross-section is oblong in shape. The second longitudinal axis is disposed at an intersection angle to the first longitudinal axis. The intersection angle may be in a range of 125° to 150°. The exhaust stack is configured to convey treated exhaust from the skirt portion to the exit port. The method may comprise: mounting the exhaust stack on the machine to at least partially enclose the engine of the machine.

In yet another aspect of the disclosure, an exhaust system disposed on a machine is disclosed. The machine has an engine and a housing that at least partially encloses the engine. The exhaust system comprises an aftertreatment apparatus and an exhaust stack. The aftertreatment apparatus is configured to receive exhaust from the engine and to output a treated exhaust to the exhaust stack. The exhaust stack includes a first conduit and a second conduit. The first conduit defines a first flow passageway in fluid communication with the aftertreatment apparatus and is arranged around a first longitudinal axis. The first conduit may include a skirt portion and a body portion disposed downstream of the skirt portion. The skirt portion may be oriented to slope outward from the body portion. The skirt portion includes a base disposed on the housing. The second conduit is disposed downstream of the first conduit. The second conduit defines a second flow passageway and is arranged around a second longitudinal axis. The second conduit includes a sidewall and an exit port. The exit port has an exit-port cross-section, wherein the exit-port cross-section is oblong in shape. The second longitudinal axis is disposed at an intersection angle to the first longitudinal axis. The intersection angle may be in a range of 125° to 150°. The exhaust stack is configured to convey the treated exhaust from the aftertreatment apparatus to the exit port.

DETAILED DESCRIPTION

Figure 1:
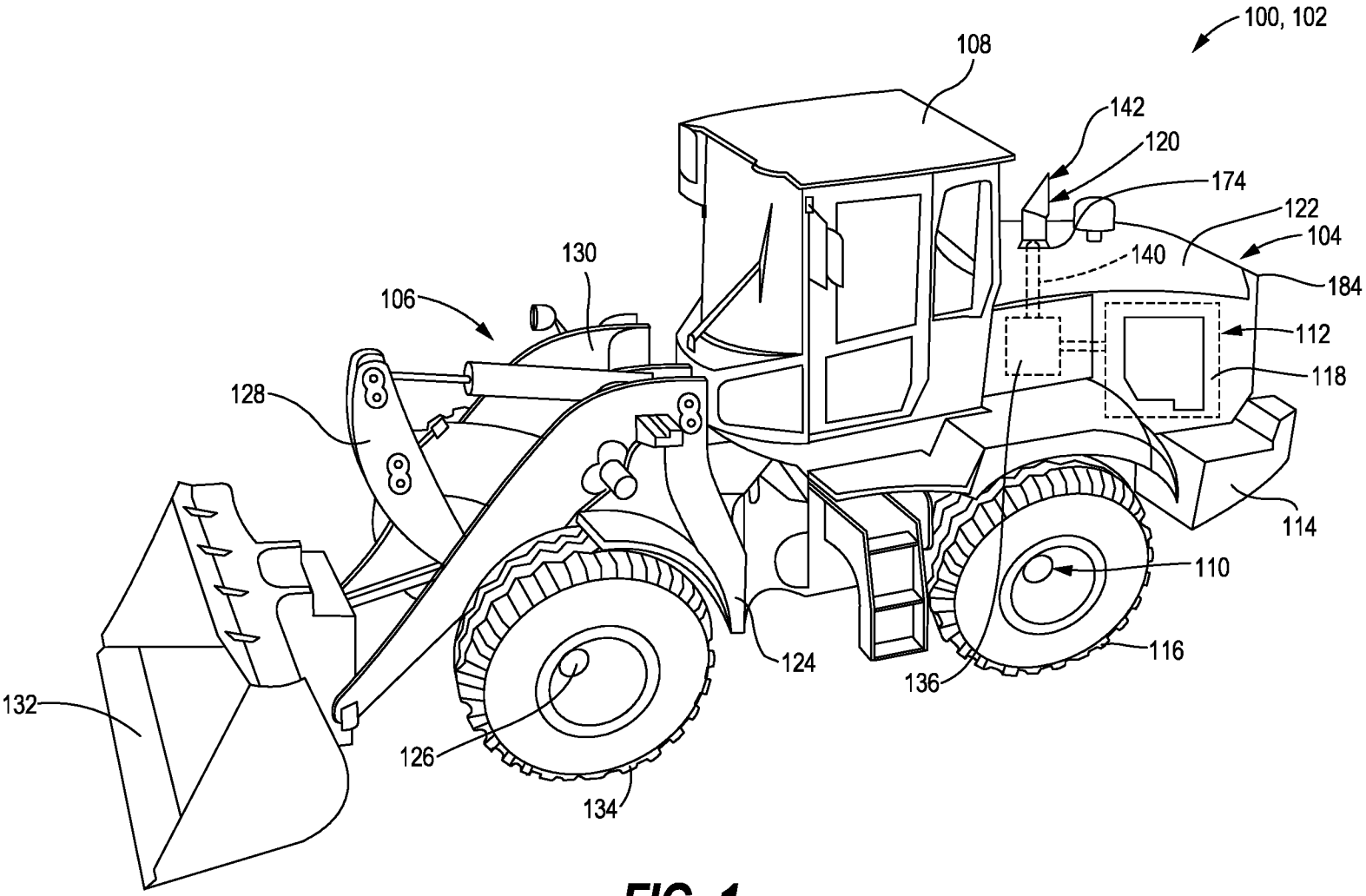
FIG. 1 is a side perspective view of an exemplary machine having an exhaust system, according to the present disclosure.

Reference will now be made in detail to specific embodiments or features, examples of which are illustrated in the accompanying drawings. Generally, corresponding reference numbers will be used throughout the drawings to refer to the same or corresponding parts, unless otherwise specified. FIG. 1 illustrates one example of a machine 100 that incorporates the features of the present disclosure. The exemplary machine 100 may be a vehicle such as wheel loader 102. While the following detailed description and drawings are made with reference to a wheel loader 102, the teachings of this disclosure may be employed on other machines 100.

The wheel loader 102 includes a rear portion 104 and a front portion 106. The rear portion 104 may include a cab assembly 108, a rear axle housing assembly 110, a power system 112 and drive train components (not shown) mounted to a rear frame 114. The rear wheels 116 may be mounted to the rear axle housing assembly 110.

The front portion 106 of the machine 100 may include a front frame assembly 124 and a front axle housing assembly 126. A boom assembly 128 and a lift arm assembly 130 may be mounted on the front frame assembly 124. An implement 132 may be attached to the boom assembly 128 and to the lift arm assembly 130. The front wheels 134 may be mounted on the front axle housing assembly 126.

Figure 2:
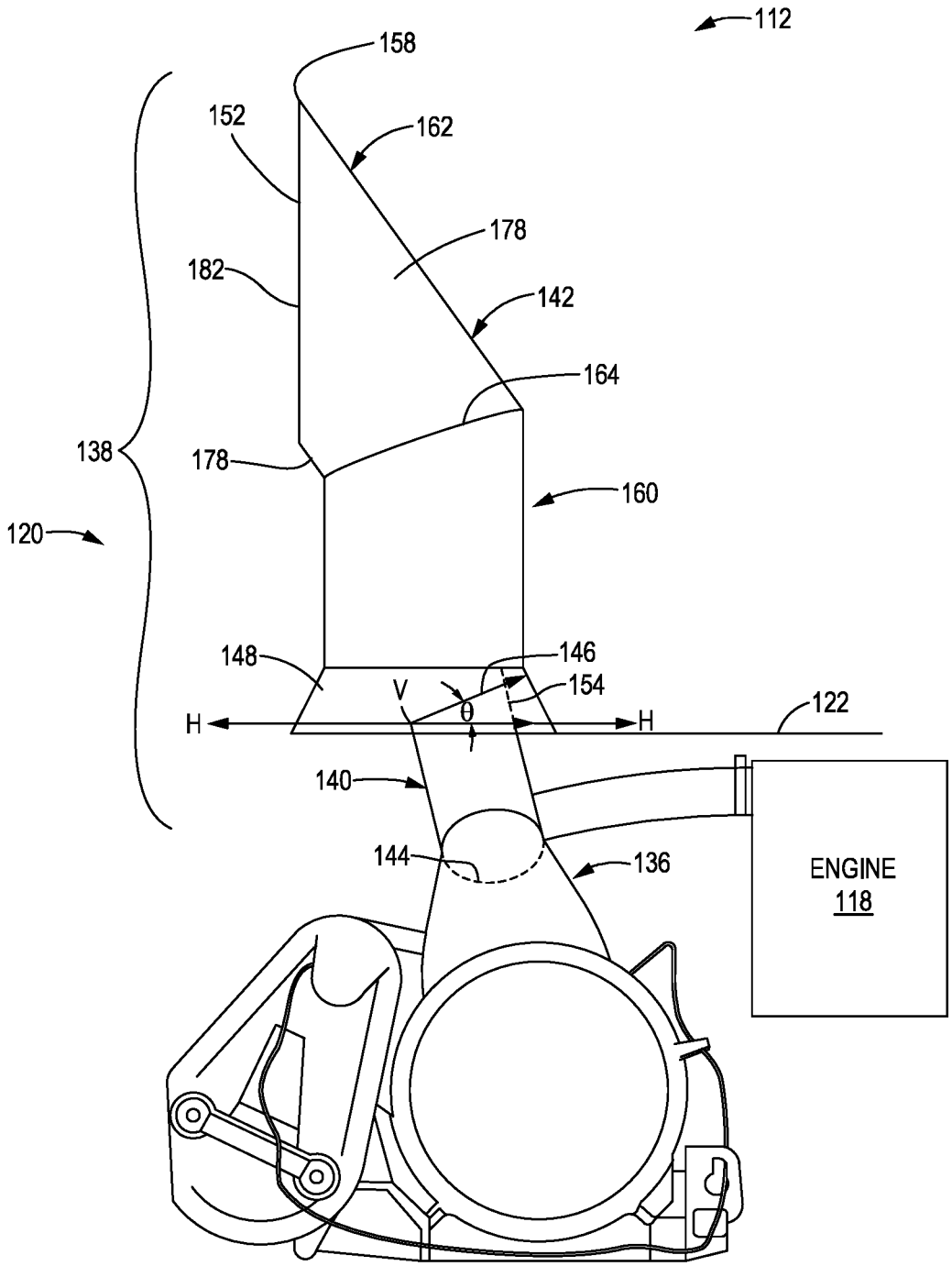
FIG. 2 is diagrammatic view of an embodiment of the power system of the exemplary machine of FIG. 1.

FIG. 2 illustrates a diagrammatic view of the power system 112. As seen in FIG. 2, the (exemplary) power system 112 may comprise an engine 118, an exhaust system 120 and a housing 122. In FIG. 2, the housing 122 is substantially removed as the housing 122 is more clearly illustrated in FIG. 1. As shown in FIG. 1, the housing 122 at least partially encloses the engine 118. The engine 118 and other drive train components (not shown) are operably coupled and are configured to generate and deliver power to operate the wheel loader 102. The engine 118 may be an internal combustion engine (e.g., gasoline, diesel, natural gas, or the like) employed with such machines 100.

Referring now to FIG. 2, the exhaust system 120 may include one or more aftertreatment apparatus 136 in fluid communication with the engine 118 and with an exhaust discharge system 138. The aftertreatment apparatus 136 is configured to receive exhaust from the engine 118, and treat such exhaust to reduce undesireable emissions present in the exhaust to output a treated exhaust 190 (see FIG. 5). As is known in the art, the aftertreatment apparatus 136 may include one or more emissions treatment members (not shown), including, but not limited to, regeneration member(s), heat source(s), oxidation catalyst(s), diesel oxidation catalysts (DOCs), diesel particulate filters (DPFs), filter(s), selective catalytic reduction catalysts (SCRs), lean NOx traps (LNTs), muffler(s), or other devices needed to treat the exhaust exiting the engine 118. For example, in the exemplary embodiment, the aftertreatment apparatus 136 may include a filter (not shown) or the like configured to remove particulate matter from the exhaust. The aftertreatment apparatus 136 is configured to output the treated exhaust 190 to the exhaust discharge system 138.

The exhaust discharge system 138 may include an ejector tube 140 and an exhaust stack 142. The exhaust stack 142 is in fluid communication with the ejector tube 140. The ejector tube 140 is in fluid communication with the one or more aftertreatment apparatus 136 and is configured to receive the treated exhaust 190 from the one or more aftertreatment apparatus 136.

Figure 3:
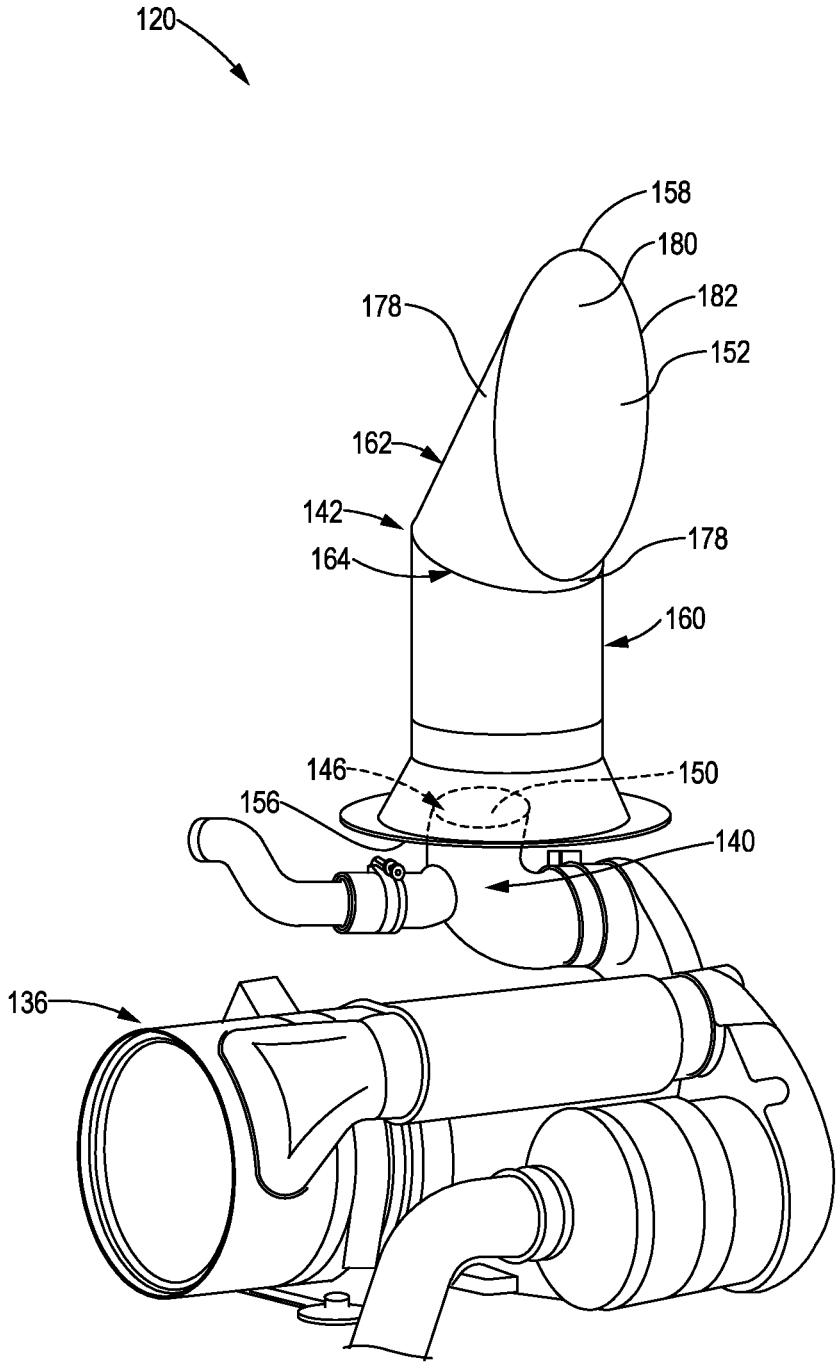
FIG. 3 is a perspective view of an embodiment of the exhaust system of FIG. 2.

The ejector tube 140 includes an inlet 144 and an outlet 146. The ejector tube 140 fluidly receives from one or more aftertreatment apparatus 136 treated exhaust 190 via the inlet 144. The ejector tube 140 is configured to convey the treated exhaust 190 from the inlet 144 to the outlet 146. The outlet 146 is disposed inside a skirt 148 portion of the exhaust stack 142. As best seen in FIG. 3, the outlet 146 has an outlet cross-section 150. In an embodiment, the outlet cross-section 150 may be oriented at an outlet angle θ (see FIG. 2) to a first horizontal plane H. As shown in FIG. 2, in an embodiment, the outlet angle θ may be (an acute angle) in the range of 15° to 25°, as measured with the vertex V on the first horizontal plane H and the rays of the outlet angle θ intersecting the wall 154 of the ejector tube 140. In an embodiment such as that shown in FIG. 5 (and discussed later herein), the outlet 146 may be oriented to substantially emit treated exhaust 190 directly out of an exit port 152 of the second conduit 162.

The exhaust stack 142 (FIG. 3) is disposed downstream of the ejector tube 140. The exhaust stack 142 has a first end 156 and a second end 158. The exhaust stack 142 includes a first conduit 160 in fluid communication with a second conduit 162. The first conduit 160 of the exhaust stack 142 is in fluid communication with the ejector tube 140 via the outlet 146. The exhaust stack 142 has a junction 164 (see also FIG. 2) at which the second conduit 162 intersects the first conduit 160.

Figure 4:
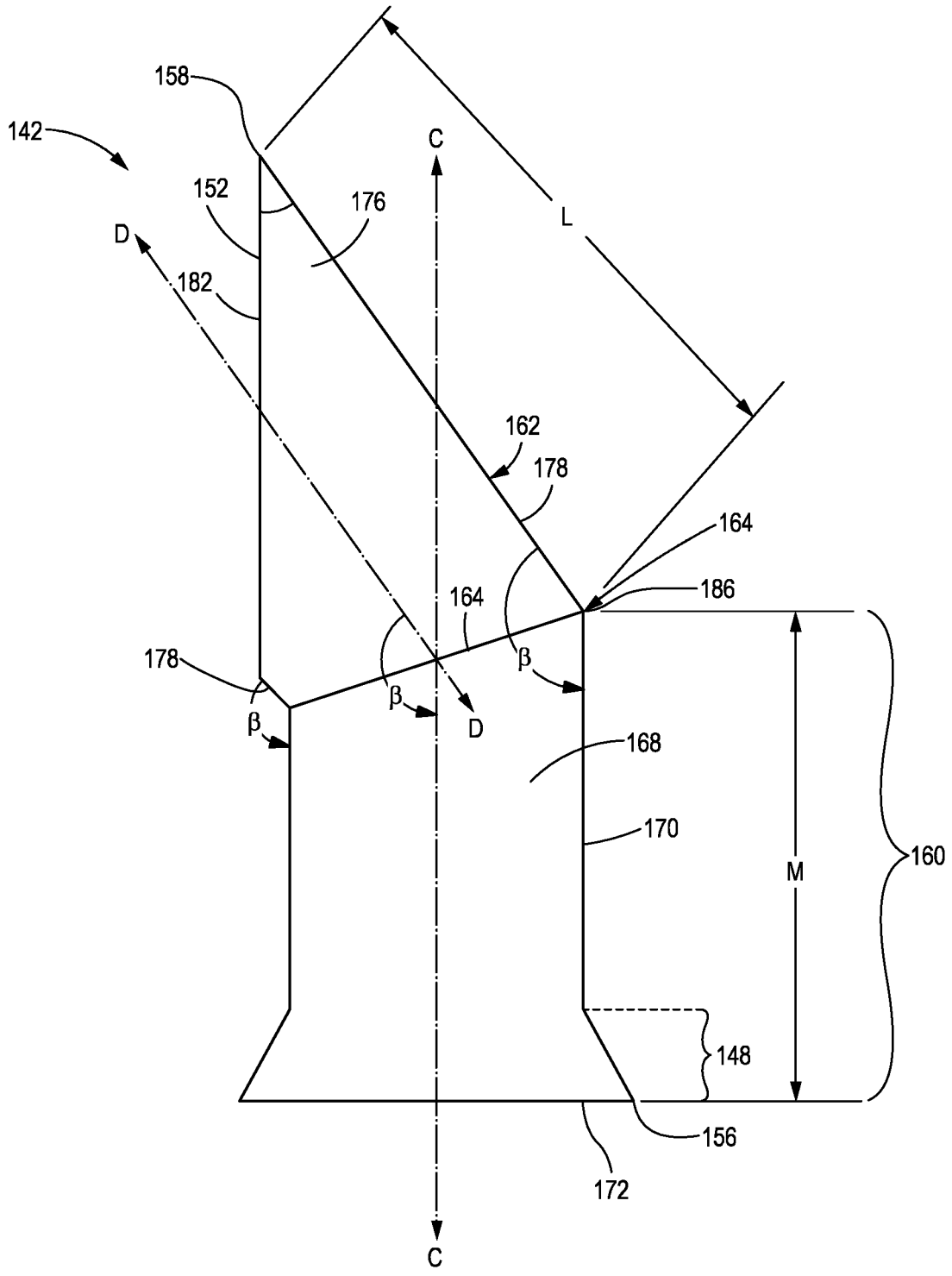
FIG. 4 side view of an embodiment of the exhaust stack of FIG. 2.

As shown in FIG. 4, the first conduit 160 defines a first flow passageway 168 and may be arranged around (e.g., in one embodiment, the first conduit 160 may be centered on) a first longitudinal axis C. The first conduit 160 includes the skirt portion 148 and a body portion 170. The body portion 170 is disposed downstream of the skirt portion 148. In an embodiment, the body portion 170 may be cylindrically shaped. The skirt portion 148 includes a base 172 disposed at the first end 156 of the exhaust stack 142. The base 172 may be mounted on an outside surface 174 (FIG. 1) of the housing 122 that is configured to enclose the engine 118 of the machine 100. In an embodiment, the skirt portion 148 (FIG. 4) may be oriented to slope outward from the body portion 170.

The second conduit 162 is disposed downstream of the first conduit 160. The second conduit 162 defines a second flow passageway 176 and may be arranged around (e.g., in one embodiment, the second conduit 162 may be centered on) a second longitudinal axis D. The second longitudinal axis D is disposed at an intersection angle β to the first longitudinal axis C. The intersection angle β is in the range of about 125° to about 150° as measured with one ray of the intersection angle β extending toward the base 172 and the other extending toward the exit port 152. The second conduit 162 includes a sidewall 178 and the exit port 152. The second conduit 162 is in fluid communication with the atmosphere (around the machine 100) via the exit port 152 (in other words, the exit port 152 emits treated exhaust 190 to outside of the machine 100).

The exit port 152 is disposed at the second end 158 of the exhaust stack 142 and has an exit-port cross-section 180 (see FIG. 3). The exit-port cross-section 180 is oblong shaped. The exit port 152 has a perimeter 182 that is defined by the sidewall 178. Such perimeter 182 is oblong shaped. The exit-port cross-section 180 and the perimeter 182 may each be oval shaped. As shown in FIG. 1, the exit port 152 may be oriented to emit exhaust toward a rear end 184 of the machine 100.

In an embodiment, the sidewall 178 (FIG. 4) of the second conduit 162 may intersect the first conduit 160 at the same intersection angle β at which the second longitudinal axis D intersects the first longitudinal axis C. A first length L of the (sidewall 178 of the) second conduit 162 measured from the exit port 152 to the junction 164 is greater than a height M of the first conduit 160 measured from the base 172 to the junction 164. In an embodiment, the second conduit 162 may be cylindrical shaped or a cylinder. In an embodiment, the junction 164 may encircle the second conduit 162 and/or the first conduit 160. The junction 164 may be oriented to slope upward as it extends from below the exit port 152 toward an opposite side 186 of the first conduit 160.

Also disclosed is a method of assembling an exhaust discharge system 138 for the machine 100. The method may comprise disposing the outlet 146 of the ejector tube 140 inside the skirt portion 148 of the exhaust stack 142 so that the outlet cross-section 150 is oriented at an outlet angle θ to a first horizontal plane, wherein the outlet angle θ is an acute angle in the range of 15° to 25°. The method may further comprise mounting the exhaust stack 142 on the machine 100 (e.g., an outside surface 174 of the housing 122 (that at least partially encloses the engine 118)).

INDUSTRIAL APPLICABILITY

In general, the foregoing disclosure finds utility in machines 100, especially earth moving machines. A new generations of power systems are being developed that provide improved engine performance in more space-efficient housings. Such engines often emit increased exhaust flow in which exhaust sound, flow and thermal temperatures must be managed to meet regulatory and commercial machine sound requirements.

Figure 5:
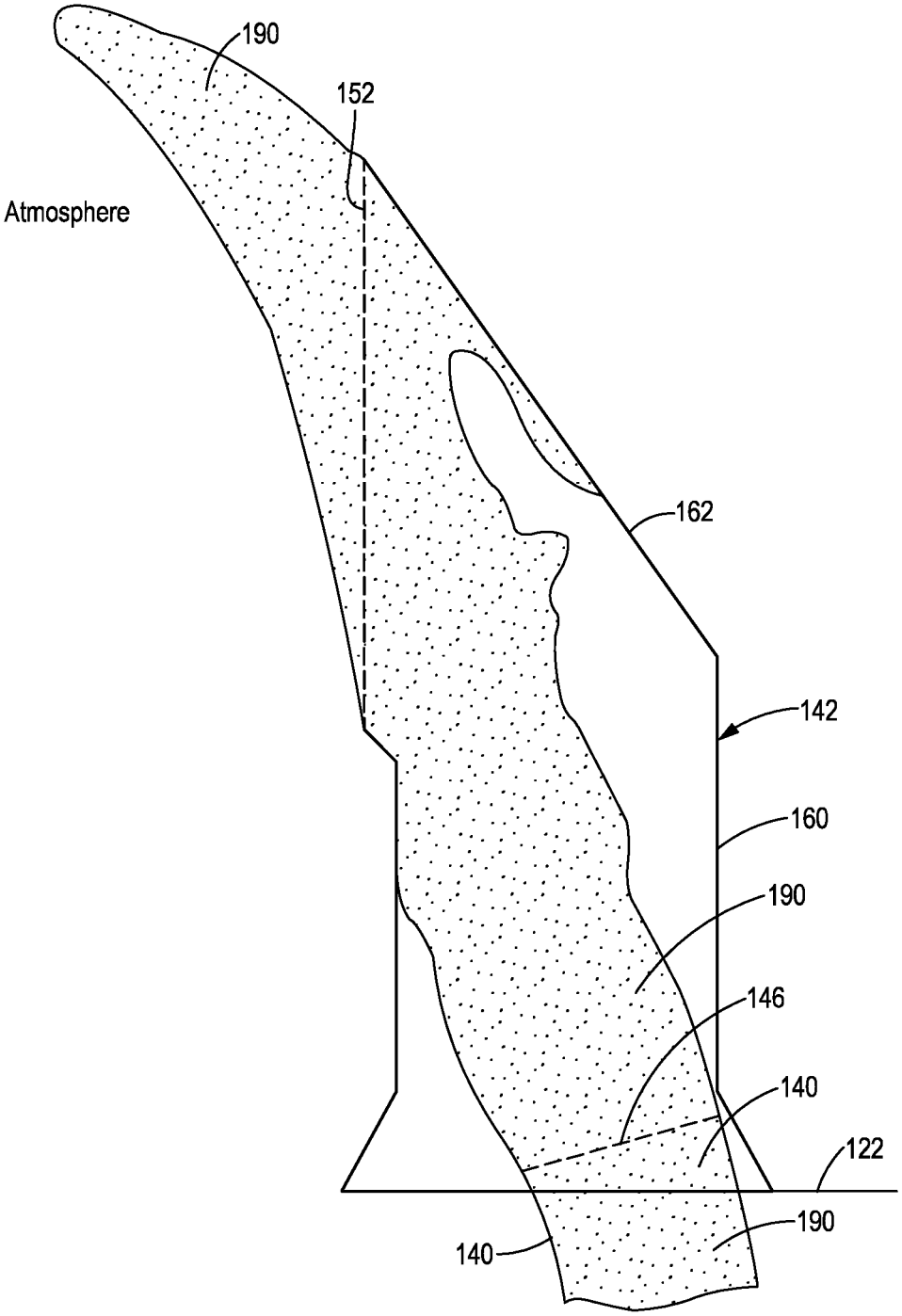
FIG. 5 is a diagrammatic view illustrating the treated exhaust flow from the outlet to the exit port.

Disclosed herein is an exhaust discharge system 138 that streamlines the treated exhaust 190 flow from the ejector tube 140 to the exit port 152 of the exhaust stack 142. The exhaust discharge system 138 reduces regional pressure in the exhaust stack 142, reduces turbulence in the exhaust stack 142 and increases the velocity of the exiting treated exhaust 190 without the use of an air injector or the like. For example, the disclosed exhaust stack 142 is free of an air injector. FIG. 5, illustrates the flow of the treated engine exhaust from the outlet 146 of the ejector tube 140 to the atmosphere via the exit port 152. As can be seen in FIG. 5, the outlet 146 may be oriented to substantially emit treated engine exhaust directly out of the exit port 152 of the second conduit 162. As used herein in this context, substantially emit means 75% or more of the treated engine exhaust is emitted directly out of the exit port 152. The ejector tube 140 and exhaust stack 142 together provide efficient flow and heat reduction in the exhaust discharge system 138 while reducing exhaust sound.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. An exhaust discharge system comprising:

an exhaust stack including a first conduit defining a first flow passageway and arranged around a first longitudinal axis, the first conduit including a skirt portion and a body portion disposed downstream of the skirt portion, the skirt portion oriented to slope outward from the body portion, and wherein the skirt portion includes a base configured to be mounted on an outside surface of a housing that is configured to at least partially enclose an engine of a machine;

a second conduit disposed downstream of the first conduit, the second conduit defining a second flow passageway and arranged around a second longitudinal axis, the second conduit including a sidewall and an exit port, the exit port having an exit-port cross-section, wherein the exit-port cross-section is oblong in shape, and wherein the exhaust stack has a junction at which the second conduit intersects the first conduit, wherein further a first length of the second conduit from the exit port to the junction is greater than a height of the first conduit from the base to the junction;

wherein the second longitudinal axis is disposed at an intersection angle to the first longitudinal axis, the intersection angle in a range of 125° to 150°; and wherein the exhaust stack is configured to convey treated exhaust from the skirt portion to the exit port.

2. The exhaust discharge system of claim 1, wherein the exit port has a perimeter that is oval shaped.

3. The exhaust discharge system of claim 1, wherein the sidewall of the second conduit intersects the first conduit at the intersection angle.

4. The exhaust discharge system of claim 1, wherein the second conduit is a cylinder and the junction encircles the second conduit.

5. The exhaust discharge system of claim 1, wherein the exit port has a perimeter defined by the sidewall.

6. The exhaust discharge system of claim 1, wherein the exit port is oriented on the machine to emit exhaust toward a rear of the machine.

7. A method of assembling an exhaust discharge system for a machine, the exhaust discharge system including an exhaust stack having a first conduit and a second conduit, the first conduit defining a first flow passageway and arranged around a first longitudinal axis, the first conduit including a skirt portion and a body portion, the skirt portion oriented to slope outward from the body portion, wherein the skirt portion includes a base configured to be mounted on an outside surface of a housing that is configured to at least partially enclose the engine of the machine, the second conduit defining a second flow passageway downstream of the first flow passageway and arranged around a second longitudinal axis, the second conduit including a sidewall and an exit port, wherein the exhaust stack has a junction at which the second conduit intersects the first conduit, wherein further a first length of the second conduit from the exit port to the junction is greater than a height of the first conduit from the base to the junction, the exit port having an exit-port cross-section, wherein the exit-port cross-section is oblong in shape, the second longitudinal axis is disposed at an intersection angle to the first longitudinal axis in a range of 125° to 150°, and the exhaust stack is configured to convey treated exhaust from the skirt portion to the exit port, the method comprising:

mounting the exhaust stack on the machine to at least partially enclose an engine of the machine.

8. The method according to claim 7, the method including:

orienting the exit port on the machine to emit exhaust toward a rear of the machine.

9. An exhaust system disposed on a machine having an engine and a housing that at least partially encloses the engine, the exhaust system comprising:

an aftertreatment apparatus configured to receive exhaust from the engine and to output a treated exhaust to an exhaust stack;

the exhaust stack includes a first conduit and a second conduit;

the first conduit defining a first flow passageway and arranged around a first longitudinal axis, the first conduit including a skirt portion and a body portion disposed downstream of the skirt portion, the skirt portion oriented to slope outward from the body portion, the skirt portion including a base disposed on the housing;

a second conduit disposed downstream of the first conduit, the second conduit defining a second flow passageway and arranged around a second longitudinal axis, the second conduit including a sidewall and an exit port, the exit port having an exit-port cross-section, wherein the exit-port cross-section is oblong in shape, and wherein the exhaust stack has a junction at which the second conduit intersects the first conduit, wherein further a first length of the second conduit from the exit port to the junction is greater than a height of the first conduit from the base to the junction;

wherein the second longitudinal axis is disposed at an intersection angle to the first longitudinal axis, the intersection angle in a range of 125° to 150°; and wherein the exhaust stack is configured to convey the treated exhaust from the aftertreatment apparatus to the exit port.

10. The exhaust system of claim 9, wherein the exit port has a perimeter that is oval shaped.

11. The exhaust system of claim 9, wherein the sidewall of the second conduit intersects the first conduit at the intersection angle.

12. The exhaust system of claim 9, wherein the second conduit is a cylinder and the junction encircles the second conduit.

13. The exhaust system of claim 9, wherein the exit port has a perimeter defined by the sidewall.

14. The exhaust system of claim 9, wherein the exit port is oriented on the machine to emit the exhaust toward a rear of the machine.

15. The exhaust system of claim 9, wherein the exhaust stack has a junction at which the second conduit intersects the first conduit, wherein the junction encircles the first conduit and is oriented to slope in an upward direction from below the exit port to an opposite side of the first conduit.

* * * * *